United States Patent [19]

Gratschew

[11] 4,327,844

[45] May 4, 1982

[54] COLLAPSIBLE TUBE-TYPE PACKAGE FOR PASTELIKE SUBSTANCES COMPRISING A RIGID CONTAINER AND AN INNER FLEXIBLE BAG

[76] Inventor: Stanislaw Gratschew, 2 kp, 37500 Lempäälä, Finland

[21] Appl. No.: 866,879

[22] Filed: Jan. 4, 1978

[30] Foreign Application Priority Data

Jan. 13, 1977 [FI] Finland ..... 770101
Jun. 3, 1977 [FI] Finland ..... 771770

[51] Int. Cl.[3] ..... B65D 35/34
[52] U.S. Cl. ..... 222/100; 222/105
[58] Field of Search ..... 222/100, 95–99, 222/101–102, 104–105, 386.5; 141/25, 27, 21; 248/108–109

[56] References Cited

U.S. PATENT DOCUMENTS

| | | | |
|---|---|---|---|
| 2,104,954 | 1/1938 | Stanton | 222/100 |
| 2,769,577 | 11/1956 | Stahmer | 222/100 |
| 3,143,249 | 8/1964 | Merrill et al. | 222/105 |
| 3,203,484 | 8/1965 | Ruggiero | 222/98 X |
| 3,954,205 | 5/1976 | Williams | 222/100 |
| 3,998,348 | 12/1976 | Sammaritano | 222/100 X |

FOREIGN PATENT DOCUMENTS

| | | | |
|---|---|---|---|
| 614684 | 9/1926 | France | 222/100 |
| 367319 | 1/1939 | Italy | 222/100 |

*Primary Examiner*—Charles A. Marmor
*Attorney, Agent, or Firm*—Ladas & Parry

[57] ABSTRACT

A package comprising a rigid outer container and a flexible inner container. The closed end of the inner container is provided with a shaft. When empty, a length of the inner container is wound around the shaft from which it is arranged to be unwound as the inner container expands during filling.

4 Claims, 8 Drawing Figures

Figure 1:
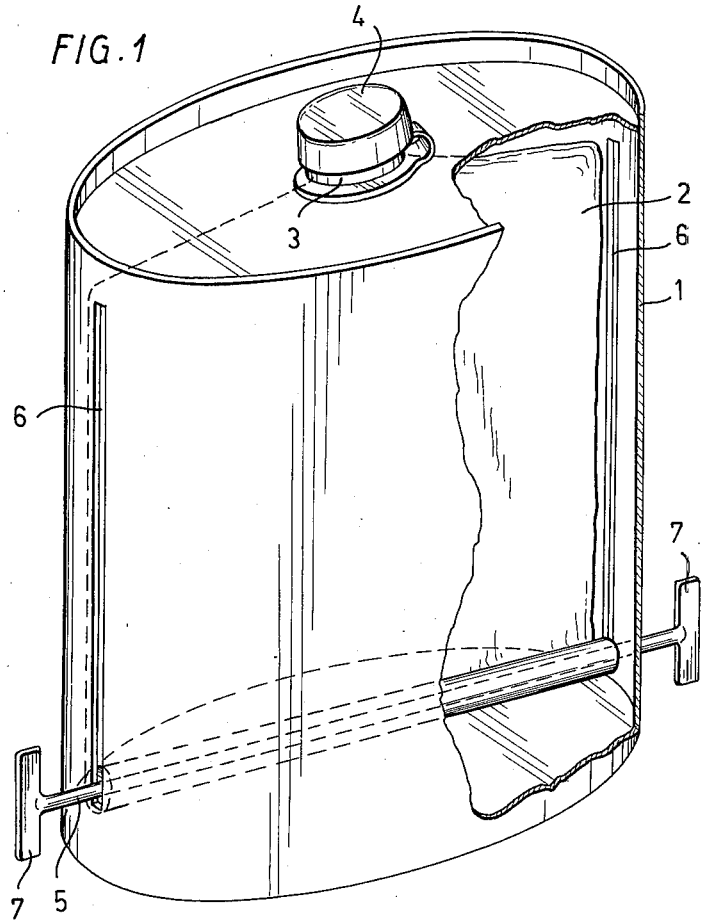

COLLAPSIBLE TUBE-TYPE PACKAGE FOR PASTELIKE SUBSTANCES COMPRISING A RIGID CONTAINER AND AN INNER FLEXIBLE BAG

Containers comprising an inner bag of a flexible material, such as plastic, and a rigid outer container are nowadays used increasingly for the transport and storage of granular and liquid substances because they due to the partly loose inner bag are easy to empty. The rigid outer container, on the other hand, facilitates the transport. These packages are, however, not as such applicable as transport and storage containers for pastelike substances, such as various jointing compounds, fats, mustard and tomato purée because it would be nearly impossible to empty the package due to the poor flow of these substances. For this reason, for example, mustard and tomato purée are transported to restaurants in big cans from which the stuff is spooned into receptacles kept on the table. Such spooning is, of course, unhygienic and, in addition, mustard changes in colour and hardens due to its repeated contact with air.

The most serious disadvantage in such packages is, however, the fact that they are difficult to fill with a pastelike substance. At the beginning of the filling the inner bag namely forms folds on the bottom of the outer container and, due to the weight of the content, these folds can no more be straightened during filling. From this follows that the outer container will be only partially filled because the inner bag is unable to expand to its full volume.

To eliminate this disadvantage, the inner bag has at the beginning of the filling been lifted up from the mouth of the outer container so that the inner bag is continuously stretched and no folds can be formed. This operation is, however, difficult and requires a lot of human labour.

On the other hand, there are known, for example emptying means for toothpaste tubes wherein a tube conventionally filled at the factory is by the consumer placed in an outer jacket having two opposite longitudinal slits through which twisters placed at the closed end of the tube can be turned to squeeze the toothpaste out of the tube.

The object of this invention is a package especially for pastelike substances comprising an outer container of a rigid material, said outer container having an emptying opening, and an inner container of a flexible material, said inner container being provided with an emptying opening secured to the emptying opening of the outer container, the end of the inner container opposite to the emptying opening end being provided with an elongated member around which the inner container can be wound.

Now it has been unexpectedly discovered that the filling of such a package can be considerably simplified by arranging the package so that the inner container when empty is longer than the distance between the emptying opening and the winding member when measured along the inner container and that this excessive length is at the beginning of the filling of the package wound around the winding member from which it is arranged to be unwound in connection with the filling of the package as the inner container expands to the desired diameter. Because the inner container is unwound from the winding member while it is being filled no folds can be formed therein and it thus finally fills the entire inner space of the outer container. In addition, the filling can be carried out fully automatically. Of special advantage is the fact that no additional means are needed to carry out the invention, but only the means needed in connection with emptying.

According to one preferred embodiment of the invention the ends of the winding member are in a way known per se journalled in elongated slits in the walls of the outer container, said ends being arranged to move along said slits while the member is moving toward the emptying opening during emptying of the inner container. By providing the wall of the outer container with slits through which the winding member can be operated the substance can be forcedly fed out of the package, wherefore the package is especially well suited to handling of pastelike substances. Thus, for example, mustard bottles placed on a table can be secured to the emptying opening of the package, whereby they are hygienically filled and the mustard hardly changes in colour or hardens.

This embodiment is, however, not applicable to every use because it has been found that said slits to some extend weaken the outer container and, as the winding member is able to move freely in the longitudinal direction of the slits it must be turned at its both ends. This is a disadvantage in that both hands must be used for turning and there is no hand left free, for example, to tilt the package.

These disadvantages are avoided in a second embodiment of the invention, wherein the winding member is rigidly mounted in the outer container close to the emptying opening thereof. Due to the rigid mounting of the winding member the slits in the outer container can be entirely eliminated and, as the rigid mounting makes a firm journalling possible, the winding member need be turned at the other end only whereby the other hand is left free, for example, to tilt the package.

Figure 2:
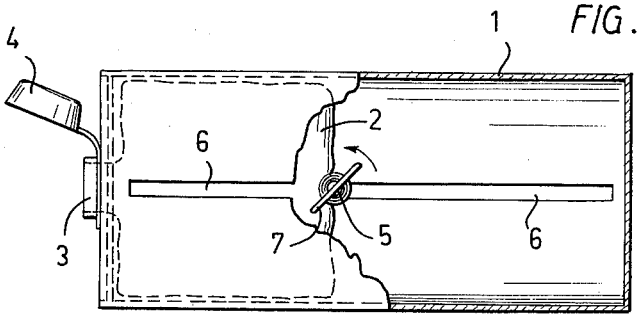

Embodiments of the package according to the invention will be described in more detail in the following with reference to the accompanying drawing, where FIG. 1 is a perspective view, partially cut away, of one embodiment of the package according to the invention, FIG. 2 illustrates the package according to FIG. 1 at the emptying stage.

Figure 3:
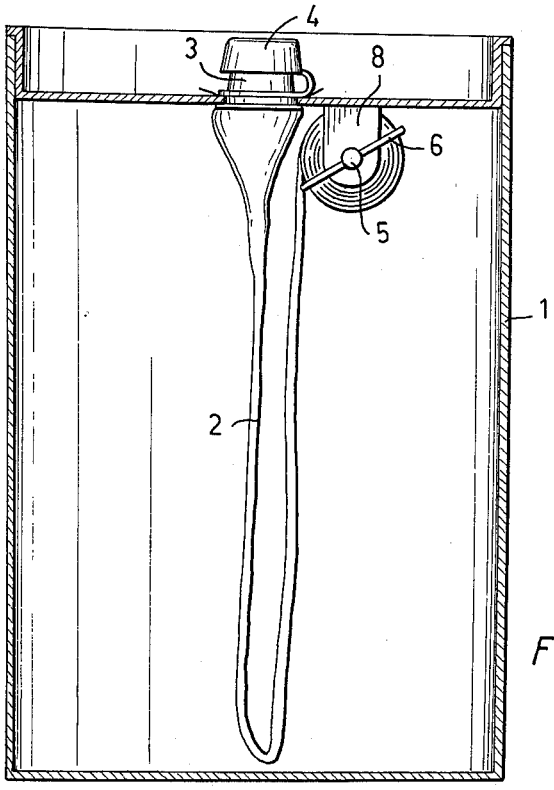
Figure 4:
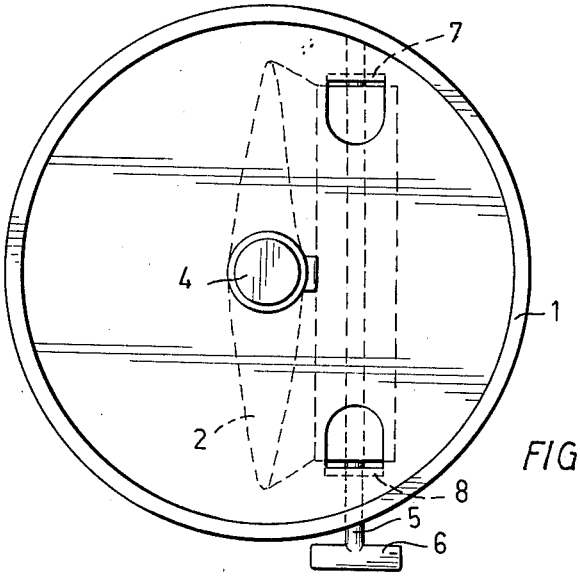
Figure 5:
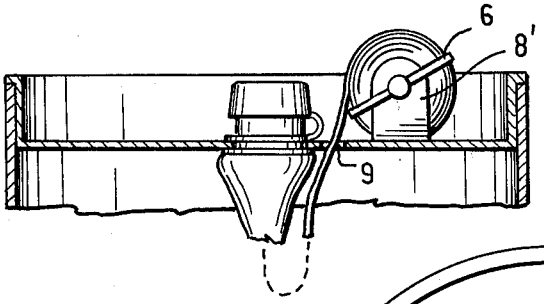
Figure 6:
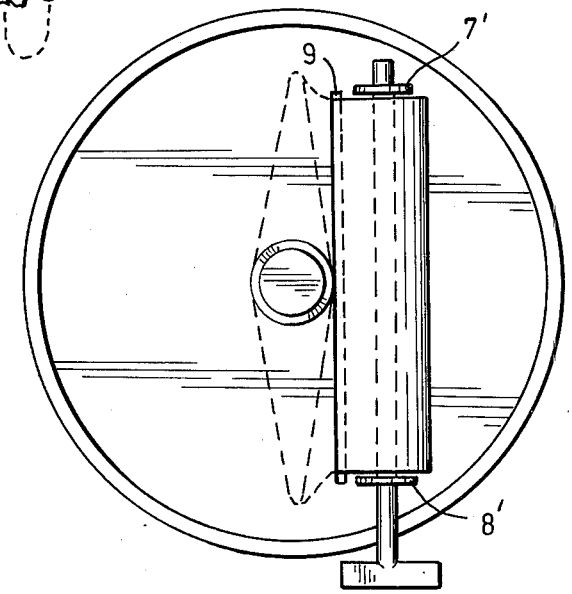
Figure 7:
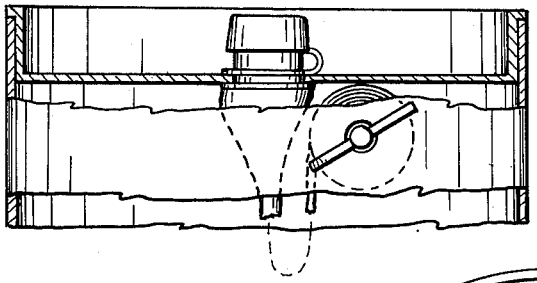
Figure 8:
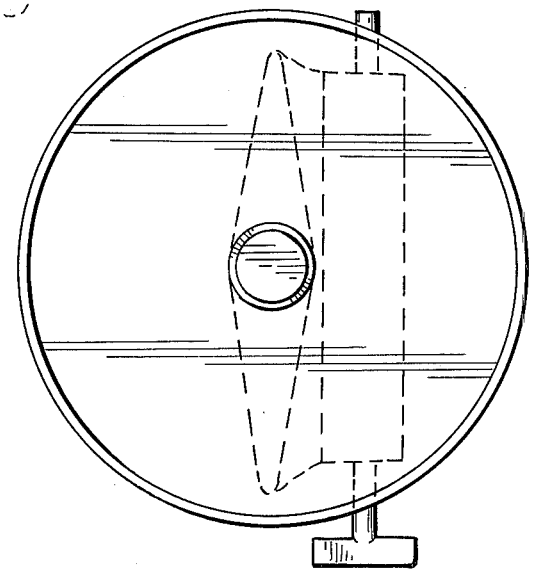

FIG. 3 illustrates a second embodiment of the package according to the invention showing the outer container in vertical section and the inner container and winding member as a side view, FIG. 4 is a top view of the package according to FIG. 3, FIG. 5 is a fragmentary view in vertical section of a third embodiment of the invention, FIG. 6 is a plan view of the embodiment of FIG. 5, FIG. 7 is a fragmentary view, partly in elevation and partly in vertical section, of a fourth embodiment of the invention, and FIG. 8 is a plan view of the embodiment of FIG. 7.

The package shown in FIGS. 1 and 2 comprises essentially an outer container 1 of a rigid material, such as metal plate, cardboard or plastic, and an inner container 2 of a flexible material, such as plastic film. The outer container is cylindrical in shape and the other end lid thereof is provided with an emptying opening 3 which has an edge and can be closed with a lid 4. The inner container is shaped like a conventional plastic bag except that the open end is provided with a narrow-necked emptying opening which is secured to the edge of the emptying opening in the outer container.

To the closed end of the inner container, preferably along the seam, a rigid shaft 5 is fixed the length whereof is bigger than the diameter of the outer container. The outer container is provided with two elongated slits 6 through which the ends of the shaft extend to the outside of the outer container. The ends of the shafts are provided with wings 7 or the like to facilitate turning. The slits 6 extend approximately from the bottom of the outer container close to the emptying opening 3 and are parallel to the centre line of the outer container.

As appears from FIG. 1, the lower portion of the empty and flat inner container is to some extent wound around the shaft 5. Due to the small air quantity in the inner container a pastelike substance can be easily fed into it because no air is discharged from the inner container during filling. As the inner container expands during filling the shaft 5 rotates, thereby unwinding more of the inner container 2 until the inner container is so expanded that it fills the inner space of the outer container more or less entirely. At the beginning of the filling, just so much of the inner container is preferably wound around the shaft that the inner container can expand sufficiently.

During transport and storage the packages are placed so that the ends of the shaft are located in the spaces between the packages.

When emptying the package, it is preferably placed on its side and the content can be emptied, for example, into a bottle which is screwed to the edge of the emptying opening 3 or into a smaller open receptable. The package is emptied by turning the shaft 5, whereby the inner container 2 is wound around the shaft and the stuff inside the inner container is squeezed out of the emptying opening. When the receptable to be filled is full, the emptying opening is closed with a lid 4.

The outer and inner containers can, of course, be shaped differently than described above. The shaft 5 can also be made so short that its ends do not reach the slits. In this case, the ends of the shaft can during transport and storage be provided with plugs which are located at the slits and which during emptying are replaced by keys by means of which the shaft can be turned. In addition, it should be noted that the slits 6 need not necessarily be parallel to the centre line of the outer container.

The package shown in FIGS. 3 and 4 is essentially similar to the package according to FIGS. 1 and 2 but differs from it in that the shaft 5 is rotatably journalled in two ears 7 and 8 which, in the embodiment shown, are stamped from the lid of the outer container and extend downward from the lid into the outer container. The ears can, of course, also be made of separate pieces and be fixed to the underside of the lid or they can be integral with the lid, in which case they are formed in connection with the moulding of the lid. The slits 6 in the outer container are thus omitted.

As shown in FIG. 3, the inner container must in this embodiment be so long that it, when empty, extends doubly close to the bottom of the outer container and, in addition, it must be wound a few turns around the shaft.

While filling the package according to the invention the inner container 2 may be entirely wound around the shaft to remove most of the air therefrom or it may be in the position shown in FIG. 3. Due to the small quantity of air in the inner container, a pastelike substance is easily fed into it because no air is discharged from the inner container during filling. As the inner container is filled the shaft rotates, thereby unwinding more of the inner container until the inner container fills the inner space of the outer container more or less entirely.

The package is emptied by turning the shaft 5, whereby the inner container 2 is wound around the shaft and the substance inside the inner container is squeezed out of the emptying opening.

Differing from what is described above the shaft 5 can also be placed outside the lid as illustrated in FIGS. 5 and 6, in which case it is located in the recess formed by the edges of the lid. In this case the inner container extends through the lid through a slit 9 parallel to the shaft, and the shaft is journalled in ears 7',8' projecting from the outer surface of the container lid. The key 6 can, if desired, be detachable whereby it does not interfere with the arrangement of the packages for transport. Instead of being journalled in the ears 7',8', the shaft 5 can be journalled in the mantle wall of the outer container, as illustrated in FIGS. 7 and 8, which still more simplifies the construction. In some cases it may be sufficient to journal the shaft only by means of one ear located close to the key end of the shaft. A bearing combination where the shaft is journalled in one ear and in one hole in the mantle wall may also be contemplated. The outer and inner containers may, of course, be differently shaped than described above and the emptying opening 3 can be located in the mantle wall of the outer container, in which case the shaft is preferably secured to outer or inner ears or holes in the mantle wall. Finally, it should be noted that a piece of hose can be attached to the emptying opening of the inner container, said hose being slideably arranged in the emptying opening 3 of the outer container such that it during emptying can be pulled out to facilitate the emptying. The hose is at the end of emptying wound on the shaft 5 in the same manner as the inner container.

What I claim is:

1. A package especially for pastelike substances comprising a rigid container having wall means which define an interior space and also define an opening, a filling and dispensing device secured in said opening and defining a passage extending between said interior space and the exterior of the container, a flexible bag of tubular form disposed in said interior space and having an open end which is secured to said filling and dispensing device whereby said passage establishes communication between the interior of the bag and the exterior of the container, said bag also having a closed end, and a roller which is rotatably mounted on said container close to the filling and dispensing device and is secured to the closed end of the bag, the bag being in a flattened condition and devoid of pastelike substance and a part of it forming windings around said roller whereby on filling the bag by way of said passage the bag may expand by unwinding from the roller to substantially fill said interior space, and wherein the container is formed with ears extending in said interior space and the roller is mounted on the container by being journalled in said ears.

2. A package as claimed in claim 1, wherein there are two ears, one at each end of the roller.

3. A package especially for pastelike substances comprising a rigid container having wall means which define an interior space and also define an opening, a filling and dispensing device secured in said opening and defining a passage extending between said interior space and the exterior of the container, a flexible bag of tubular form disposed in said interior space and having an open end which is secured to said filling and dispensing device whereby said passage establishes communication between the interior of the bag and the exterior of the container, said bag also having a closed end, and a roller which is rotatably mounted on said container close to the filling and dispensing device and is secured to the closed end of the bag, the bag being in a flattened condition and devoid of pastelike substance and part of it forming windings around said roller whereby on filling the bag by way of said passage the bag may expand by unwinding from the roller to substantially fill said interior space, and wherein the container is formed with ears extending to the exterior of the container and the roller is mounted on the container by being journalled in said ears.

4. A package as claimed in claim 3, wherein there are two ears, one at each end of the roller.

* * * * *